US006724282B2

(12) United States Patent
Kao

(10) Patent No.: US 6,724,282 B2
(45) Date of Patent: Apr. 20, 2004

(54) STRUCTURE OF DIGITAL TRANSMISSION LINE

(76) Inventor: Ta San Kao, No. 2-1, Wen Hua Rd., Tung Hu Village, Ku Keng Hsiang, Yun Lin Hsien (TW)

( * ) Notice: Subject to any disclaimer, the term of this patent is extended or adjusted under 35 U.S.C. 154(b) by 0 days.

(21) Appl. No.: 10/106,504

(22) Filed: Mar. 27, 2002

(65) Prior Publication Data

US 2003/0184418 A1 Oct. 2, 2003

(51) Int. Cl.[7] ..... H01P 3/06; H01B 7/00
(52) U.S. Cl. ..... 333/243; 174/106; 174/120 R
(58) Field of Search ..... 333/243; 174/106, 174/117 F, 120 R, 110 F

(56) References Cited

U.S. PATENT DOCUMENTS 4,475,006 A * 10/1984 Olyphant, Jr. ..... 174/36
4,701,576 A * 10/1987 Wada et al. ..... 174/117 F
5,142,100 A * 8/1992 Vaupotic ..... 174/24
5,266,744 A * 11/1993 Fitzmaurice ..... 174/103
5,563,376 A * 10/1996 Hansell et al. ..... 174/102 R
6,540,531 B2 * 4/2003 Syed et al. ..... 174/68.3
2001/0032732 A1 * 10/2001 Fujino et al.

* cited by examiner

*Primary Examiner*—Patricia Nguyen
(74) *Attorney, Agent, or Firm*—Troxell Law Offices PLLC

(57) ABSTRACT

A structure of digital transmission line having a core material, a middle material layer and a coating layer. The core material is a transmission medium enveloped with an insulation PE foam layer. The coating layer includes at least one layer and is made of polyvinyl chloride. The middle material layer is provided between the core material and the coating layer, and is characterized by that the middle material layer is comprised of a copper foil wrapping layer, at least a metallic-wire knitting layer and a foamed Telfon-tape wrapping layer (PTFE). The middle material layer can get 100% obscuring, can minimize the degree of mutual interference, can maintain the characteristic impedance at 75Ω, and can get the result that no refraction or reflection of transmitted signals is induced during transmission.

5 Claims, 3 Drawing Sheets

STRUCTURE OF DIGITAL TRANSMISSION LINE

BACKGROUND OF THE INVENTION

1. Field of the Invention

The present invention is related to a structure of digital transmission line, and especially to such a structure having the characteristic impedance thereof maintained at 75Ω, when in transmission, no refraction or reflection of signal is induced; the digital transmission line particularly suits signal transmission.

2. Description of the Prior Art

Conventional structures of signal transmission lines, such as the coaxial cable structure shown in FIG. 1, are characterized in that: the insulation portion enveloping a conductor 1 is made a cylinder member 2 formed as a coaxial cable by press shaping of PE, and is combined with a Mylar tape 3 made from aluminum foil, an obscuring layer 4 made by knitting copper lines and a PVC enveloping member 5.

The coaxial cable is a round PE pipe made by press shaping, in order to lower its electric capacity and attenuation rate. However, the effect of insulation of PE is not the best, and the obscuring layer is not able to make 100% obscuring, and it is still a problem to be solved that it is not certain whether the characteristic impedance can be maintained under 75Ω, what will be the degree of mutual interference among a magnetic field, radio frequencies and static electricity, and whether refraction or reflection of transmitted signals is induced during transmission.

Thereby, it is the motive of the present invention to improve on the conventional structure of coaxial cables with the above stated defects, and to provide a structure of digital transmission line able to make 100% obscuring, to minimize the degree of mutual interference among a magnetic field, radio frequencies and stationary electricity, to maintain the characteristic impedance at 75Ω and to assure no refraction or reflection of transmitted signals is induced during transmission.

SUMMARY OF THE INVENTION

The primary object of the present invention is to provide a structure of digital transmission line of which the characteristic impedance can be maintained at 75Ω.

The secondary object of the present invention is to provide a structure of digital transmission line with which the degree of mutual interference can be minimized, and 100% obscuring can be obtained.

Another object of the present invention is to provide a structure of digital transmission line with which no refraction or reflection of transmitted signals is induced during transmission.

To achieve the above stated objects, the present invention is comprised of a core material, a middle material layer and a coating layer; the core material is a transmission medium enveloped with an insulation polyethylene (PE) foam layer; the coating layer includes at least one layer and is made of polyvinyl chloride (PVC), the middle material layer is provided between the core material and the coating layer, and is characterized by that the middle material layer is comprised of a copper foil wrapping layer, at least a metallic-wire knitting layer and a foamed Teflon-tape wrapping layer (polytetrafluoroethylene, PTFE). The middle material layer can get 100% obscuring, can minimize the degree of mutual interference, can maintain the characteristic impedance at 75Ω, and can get the result that no refraction or reflection of transmitted signals is induced during transmission.

The present invention will be apparent after reading the detailed description of the preferred embodiment thereof in reference to the accompanying drawings.

DETAILED DESCRIPTION OF THE PREFERRED EMBODIMENT

Figure 1:
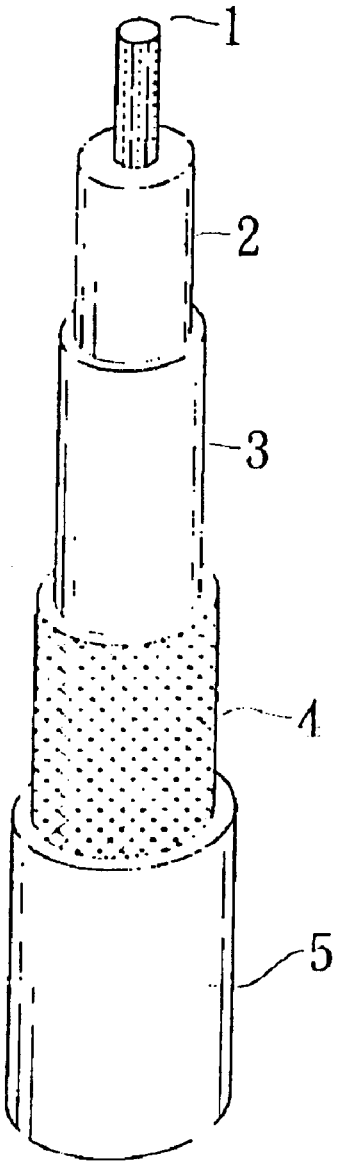
Fig. 1 Prior Art
FIG. 1 is an analytical perspective view showing the structure of a conventional coaxial cable.
Figure 2:
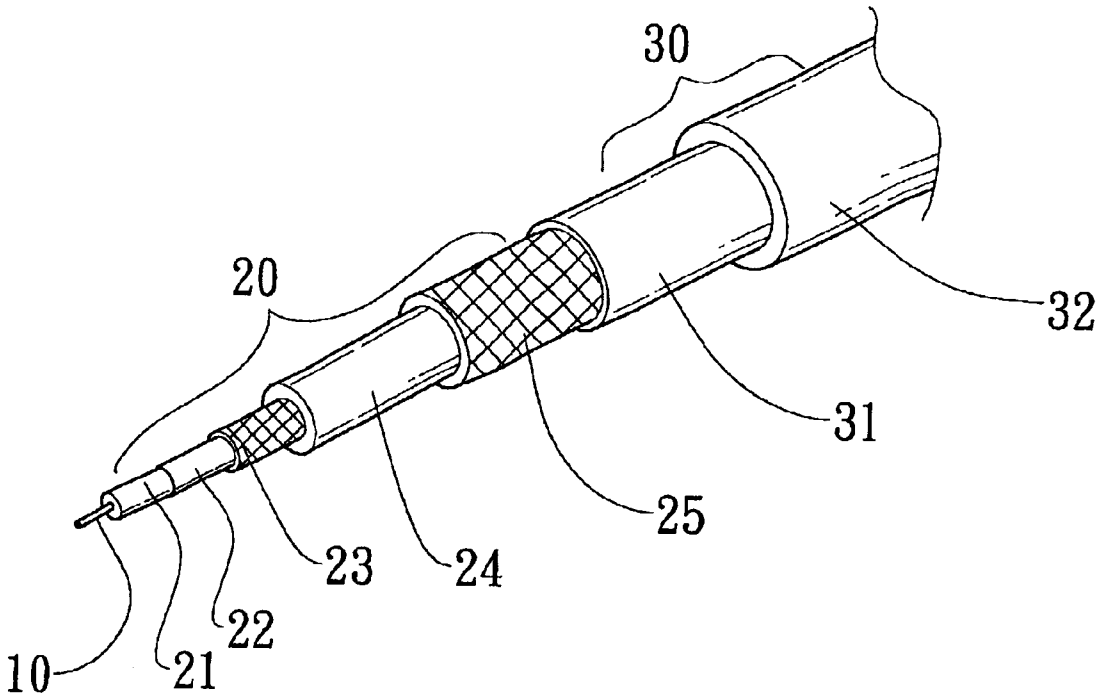
FIG. 2 is an analytical perspective view showing the structure of an embodiment of the present invention.

Referring firstly to FIG. 2, the present invention is comprised of a core material 10, a middle material layer 20 and a coating layer 30; wherein, the core material 10 is a transmission conductor made of pure silver with a large transmission speed; the middle material layer 20 is comprised of an insulation PE foam layer 21, a copper foil wrapping layer 22, a metallic-wire knitting layer 23, a foamed Teflon-tape (PTFE) wrapping layer 24 and another metallic-wire knitting layer 25. The metallic wires in the metallic-wire knitting layers 23, 25 are plated with silver. The coating layer 30 is comprised of a first coating layer 31 and a second coating layer 32 made of polyvinyl chloride (PVC).

Figure 3:
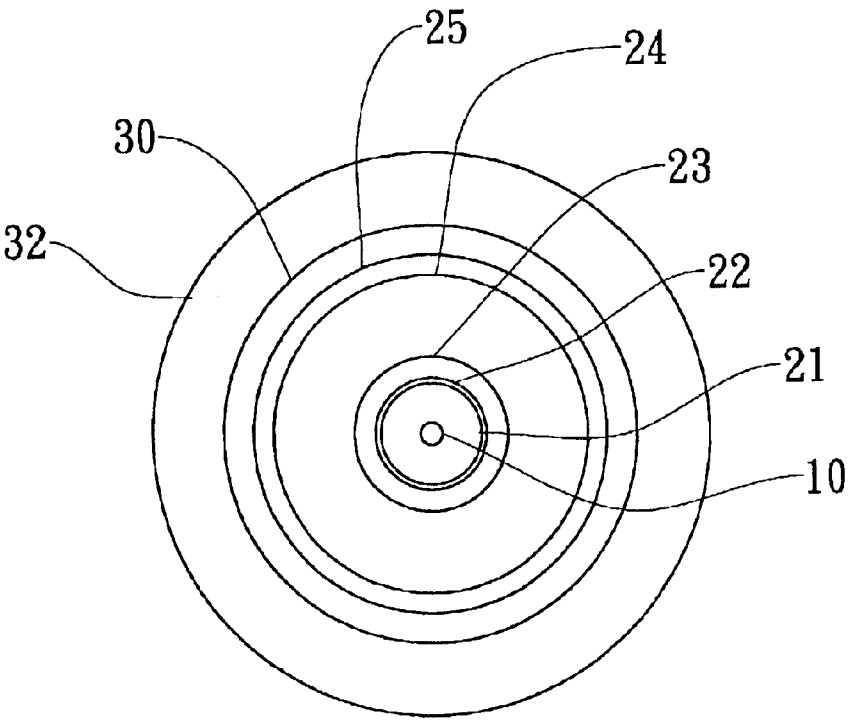
FIG. 3 shows a cross section of the embodiment of the present invention.

Referring to FIGS. 2 and 3, the core material 10 is in the first place enveloped with the PE foam layer 21, and then is enveloped with the copper foil wrapping layer 22, the metallic-wire knitting layer 23, the foamed Teflon-tape (PTFE) wrapping layer 24 and the metallic-wire knitting layer 25 sequentially of the middle material layer 20. Finally, it is enveloped on the outermost surface thereof with the first coating layer 31 and the second coating layer 32 of the coating layer 30 to complete the structure of the present invention.

By virtue that transmission speed of silver is the largest among the elements of the same class of it, and insulation of foamed PE materials is good, plus the summed obscuring ability of the copper foil wrapping layer and the two metallic-wire knitting layers can provide 100% obscuring, thereby, interference among a magnetic field, radio frequencies and static electricity can be effectively reduced; and more, the Teflon in the foamed Teflon-tape (PTFE) wrapping layer has a minimum insulation coefficient, its effect of insulation is the best, hence the degree of mutual interference can be minimize, and the characteristic impedance of the line can be maintained under 75Ω, thereby, attenuation rate can be reduced, distortion can be small, and quality of the line can be superior.

The structure of digital transmission line of the present invention can get a good effect of obscuring; it can avoid interference of a magnetic field, radio frequencies and static electricity. Therefore, it is novel and inventive in comparison with the electric wires available now. Having thus described the technical structure of my invention with industrial value, the structure has never existed in the markets, therefore,

What I claim as new and desire to be secured by Letters Patent of the United States are:

1. A digital transmission line comprising:

a) a core material;

b) a middle material layer formed on the core material, the middle material layer including:

i) a PE foam layer;

ii) a copper foil wrapping layer on the PE foam layer;

iii) a first metallic-wire knitting layer on the copper foil wrapping layer;

iv) a foamed PTFE wrapping layer on the first metallic-wire knitting layer; and v) a second metallic-wire knitting layer on the foamed PTFE wrapping layer; and c) at least one coating layer formed on the middle material layer.

2. The digital transmission line according to claim 1, wherein the first and the second metallic-wire knitting layers are coated with silver.

3. The digital transmission line according to claim 1, wherein the at least one coating layer includes two coating layers.

4. The digital transmission line according to claim 1, wherein the at least one coating layer is polyvinyl chloride.

5. The digital transmission line according to claim 1, wherein the core material is silver.

* * * * *